US005365418A

United States Patent [19]

Gardner

[11] Patent Number: 5,365,418

[45] Date of Patent: Nov. 15, 1994

[54] TRAFFIC LIGHT

[75] Inventor: James L. Gardner, Turramurra, Australia

[73] Assignee: Commonwealth Scientific and Industrial Research Organisation, Campbell, Australia

[21] Appl. No.: 946,481

[22] PCT Filed: May 9, 1991

[86] PCT No.: PCT/AU91/00197

§ 371 Date: Nov. 10, 1992

§ 102(e) Date: Nov. 10, 1992

[87] PCT Pub. No.: WO91/18242

PCT Pub. Date: Nov. 28, 1991

[30] Foreign Application Priority Data

May 11, 1990 [AU] Australia ..... PK 0100

[51] Int. Cl.[5] ..... F21V 13/04

[52] U.S. Cl. ..... 362/308; 362/309; 362/310

[58] Field of Search ..... 362/308, 309, 310, 327, 362/328, 329, 337, 339

[56] References Cited

U.S. PATENT DOCUMENTS 1,581,491 4/1926 Rhodes ..... 362/309
1,626,615 5/1927 Kirby et al. ..... 362/339
2,124,417 7/1938 Hamel et al. ..... 362/309
3,428,800 2/1969 Levin et al. ..... 362/339
3,818,218 6/1974 Heenan et al. ..... 362/309

FOREIGN PATENT DOCUMENTS 527534 4/1954 Belgium .
144282 9/1921 United Kingdom .
2013323 8/1979 United Kingdom .

*Primary Examiner*—Richard R. Cole
*Attorney, Agent, or Firm*—Leydig, Voit & Mayer

[57] ABSTRACT

A signalling light including a light source, a fresnel lens having an area to provide an output beam, and a reflective surface. The reflective surface partially surrounds the light source and defines an opening directed toward the fresnel lens. The opening has an area substantially less than the area of the fresnel lens so that light that is available for the production of phantom signals is reduced with respect to any external light that enters via the fresnel lens. In use, a portion of said fresnel lens is directly radiated through said opening by light from said source and said reflective surface directs substantially any remainder of the light from said source toward said fresnel lens to substantially evenly illuminate all of the available fresnel lens area.

3 Claims, 3 Drawing Sheets

TRAFFIC LIGHT

TECHNICAL FIELD

The present invention relates to lights and in particular to signalling lights.

The invention has been developed primarily for use with signalling lights for traffic control and will be described hereinafter with reference to this application. However, it will be appreciated that the invention is not limited to this particular field of use and is also suitable for warning and indicating lights.

BACKGROUND ART

The function of traffic signalling lights is to project a beam of light at specific angles through an aperture of predetermined cross sectional area. Endeavouring to achieve this end, an internal light source provides illumination to a suitable lens. To facilitate more efficient illumination a reflective surface, usually of parabolic shape, is employed to re-direct toward the lens light from the internal source which would otherwise be wasted. The combined action of the reflective surface and reflection from the filament and envelope of the internal source also causes light from external sources, such as the sun, to be re-directed toward the lens, which can lead an observer to believe that the light is on, when in fact the internal source is off. Such an occurrence is known as a "phantom signal".

DISCLOSURE OF THE INVENTION

It is an object of the present invention to provide a relatively simple signalling light which overcomes or substantially ameliorates the disadvantage of the prior art.

According to the invention there is provided a signalling light including a light source, a lens of the type commonly described as a fresnel lens to provide an output beam, and a reflective surface partially surrounding said light source defining an opening directed toward said fresnel lens and having an area substantially less than the area of the fresnel lens so that the amount of light that is available for the production of phantom signals is reduced with respect to the amount of any external light that enters via the fresnel lens and wherein in use, a portion of the fresnel lens is directly radiated through the opening by light from the source and the reflector directs substantially the remainder of the light from the source toward said fresnel lens to substantially evenly illuminate all of the available fresnel lens area.

Preferably, the reflective surface and the lens are fixedly spaced by a non-reflective support means.

Preferably also, a further lens is included, adjacent to and following the fresnel lens, for providing different angular spread of the light in the horizontal and vertical directions.

Preferable also, the area of the opening of the reflective surface is one half or less of the area of the fresnel lens.

In a preferred form the reflector is shaped so that the combination of reflected light and direct light results in a substantially uniform illumination of the surface of the fresnel lens. The shape of the fresnel lens surface is dependent upon the geometric arrangement of the source, reflector and fresnel lens.

It will be apparent that the fresnel lens collimates the light passing through it which originates from the internal light source.

BRIEF DESCRIPTION OF THE DRAWINGS

A preferred embodiment of the invention will now be described, by way of example only, with reference To the accompanying drawings in which.

MODES FOR CARRYING OUT THE INVENTION

Figure 1:
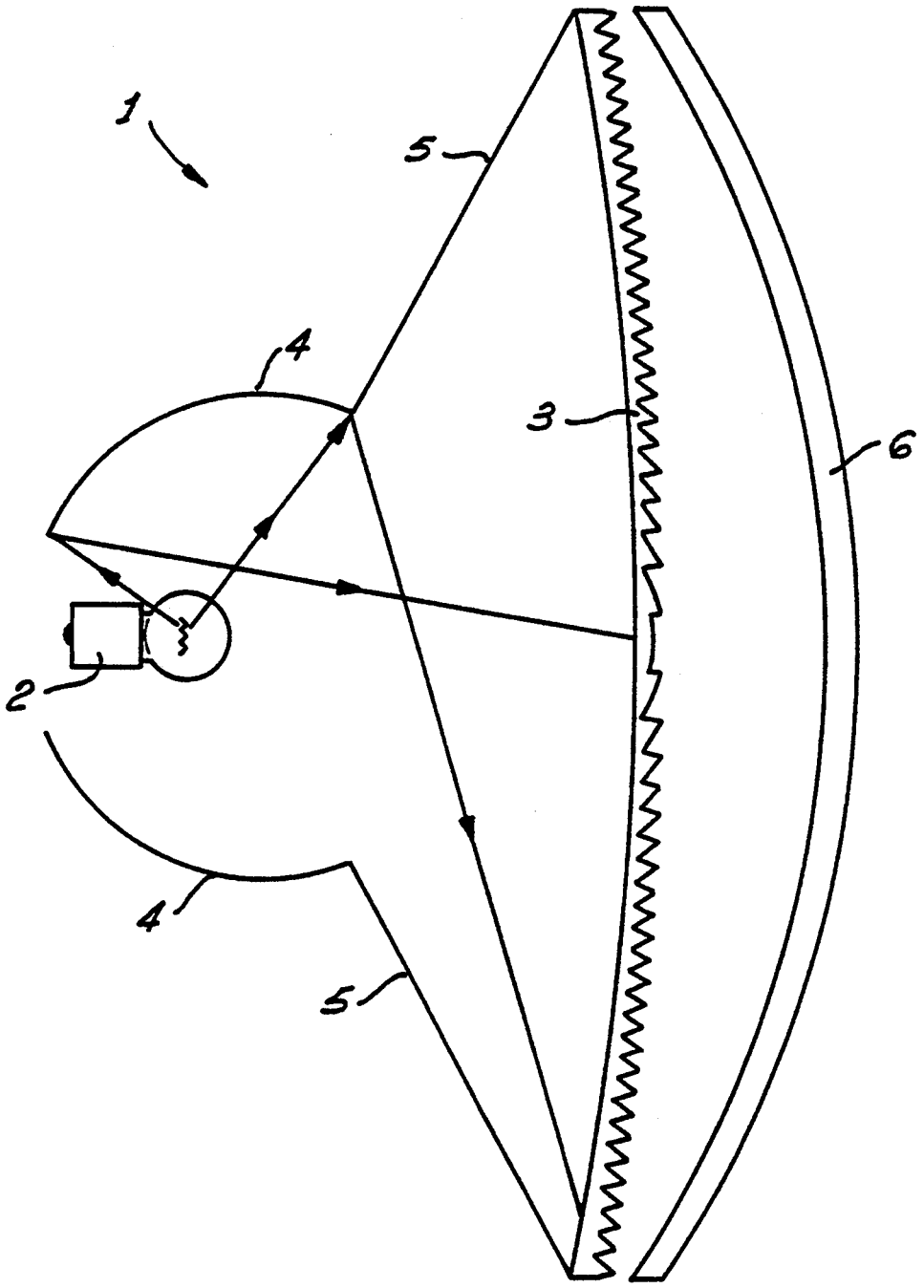
FIG. 1 is a cut-away side elevation of a signalling light according to the invention.

Referring to FIG. 1 the signalling light 1 includes a light source in the form of an electric globe or bulb 2 and fresnel lens 3 to provide an output beam. A reflective surface 4 partially surrounds the electric globe and defines an opening directed toward the fresnel lens 3 which has an area substantially less than that of the fresnel lens. A portion of the fresnel lens is directly irradiated through the opening by light from the globe 2, and the reflective surface 4 directs substantially the remainder of the light from the globe toward the fresnel lens.

The fresnel lens 3 and the reflective surface 4 are fixedly spaced by a non-reflective support means 5. The support means is designed to prevent light falling upon it being re-directed toward the fresnel lens 3. This result is achieved by a light absorbent coating, but could be similarly obtained by suitable structuring of the support means.

A further external lens 6 is included in this embodiment to provide the different angular spread in the horizontal and vertical directions that is required for this particular signalling light. These are well known to those skilled in the art.

The reflective surface 4 is arranged to provide uniform illumination of the fresnel lens 3 by the light source 2, thus effectively utilising all the lens area available. This provides for a clear indication to an observer of a signal from the signalling light.

Figure 2:
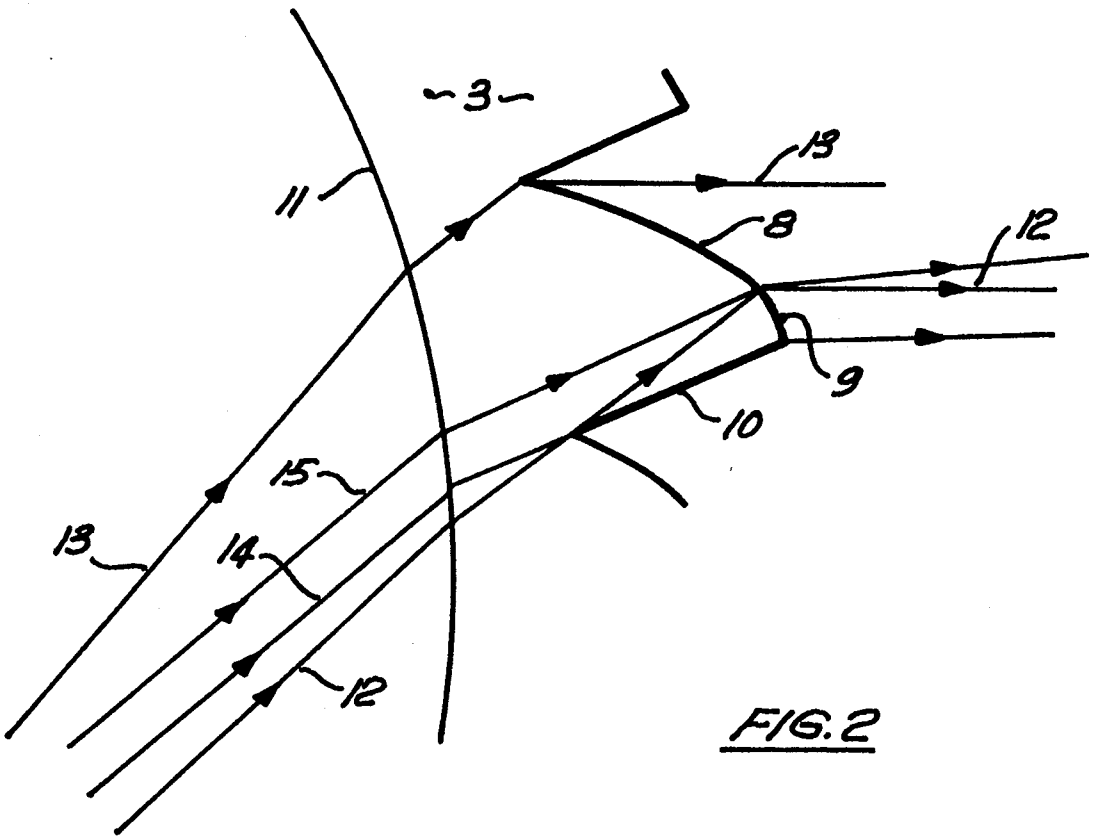
FIG. 2 is an enlarged cut away section of the fresnel lens of FIG. 1 showing the path taken by light originating from the light source.

The operation of the signalling light is explained in conjunction with FIG. 2. The fresnel lens 3 is comprised of sections of approximately equal thickness, one of which is shown. These sections have three regions 8, 9 and 10 for producing a desired deflection of impinging light. The inner face 11 is curved to provide strengthening of the fresnel lens.

The light rays which approach the fresnel lens from the reflective surface 4 lie in the range between rays 12 and 13. These rays pass through region 8 which is shaped to control the direction of exit of the rays and such that they emerge parallel.

The light rays from the source directly illuminating the fresnel lens 3 are in the range between rays 14 and 15. These rays pass through region 9 at the fresnel lens and also have their direction of exit controlled. This combination is effective as substantially all the light emitted from the light source 2 is utilised for signalling purposes.

Figure 3:
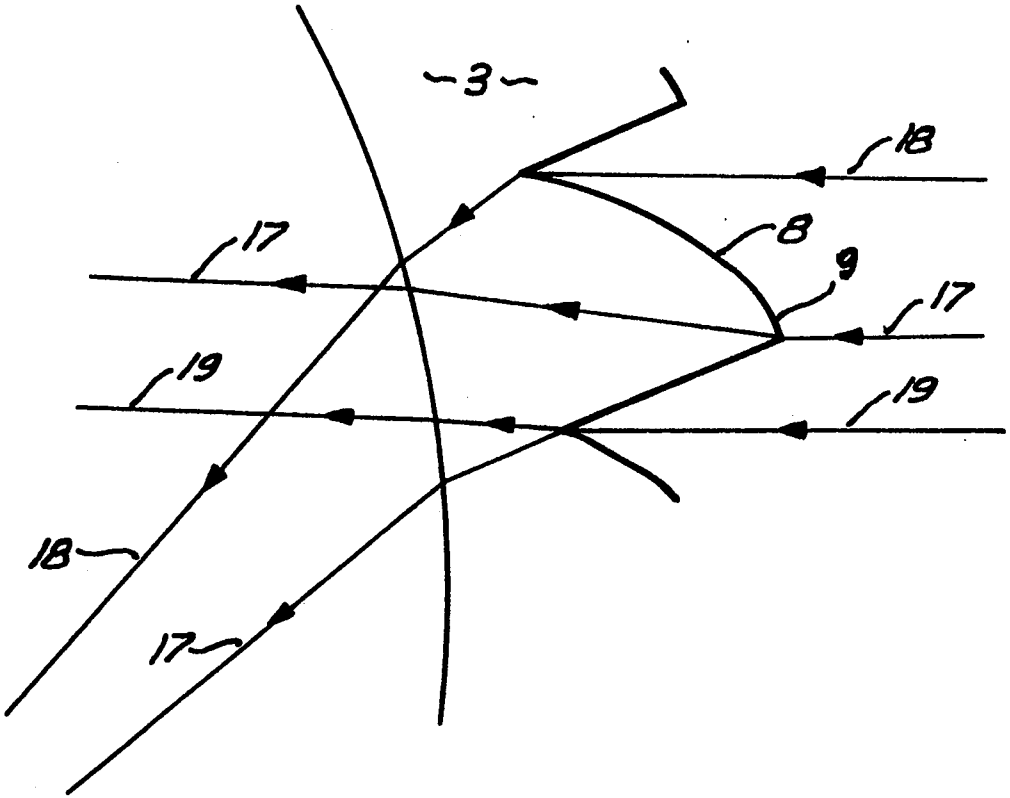
FIG. 3 is the fresnel lens of FIG. 2 showing the path taken by light originating from an external source.

Referring now to FIG. 3 the operation of the signalling light in response to an external source of light is illustrated.

The light rays between 17 and 18 originating from an external source and impinging the fresnel lens 3 at regions 8 and 9 will, by the action of the fresnel lens, be directed toward the light source, and could thus create a "phantom". However, light rays between 17 and 19 originating from an external source impinge the fresnel lens at region 10 and are directed toward the support means, thereby unable to produce a phantom signal.

This reduction in the amount of light available for the production of phantom signals is due to the opening of the reflective surface 4 having an area substantially less than that of the fresnel lens.

For signalling purposes either or both of the lens 3 and 6 could be coloured. In this preferred embodiment only the fresnel lens 3 is coloured.

This combination reduces the intensity of the colour phantom produced by reflection from surface 11 of the fresnel lens. This is done by means of dilution of the coloured phantom by uncoloured phantoms originating from reflections at the other lens/air interfaces.

Due to practical constraints the reflective surface 4 only illuminates the fresnel lens 3 to a predetermined radius. The result is that the fresnel lens at a radius beyond that mentioned is only required to re-direct light which directly illuminates the fresnel lens.

The invention as presently contemplated provides for efficient use of a light source in a signalling light, while substantially reducing the production of "phantom" signals, thus conferring a distinct advantage over the prior art.

Although the invention has been described with reference to a specific example, it will be appreciated by those skilled in the art that the invention may be embodied in many other forms.

I claim:

1. A signalling light including:

a light source;

a fresnel lens having an area to provide an output beam; and a reflective surface partially surrounding said light source defining an opening directed toward said fresnel lens and having an area substantially less than the area of said fresnel lens so that light that is available for the production of phantom signals is reduced with respect to any external light that enters via the fresnel lens and wherein in use, a portion of said fresnel lens is directly radiated through said opening by light from said source and said reflective surface directs substantially any remainder of the light from said source toward said fresnel lens to substantially evenly illuminate all of the available fresnel lens area, wherein said reflective surface and said lens are fixedly spaced by a non-reflective support means.

2. The signalling light according to claim 1 wherein said support means includes a light absorbent coating.

3. A signalling light including:

a light source;

a fresnel lens having an area to provide an output beam;

a reflective surface partially surrounding said light source defining an opening directed toward said fresnel lens and having an area substantially less than the area of said fresnel lens so that light that is available for the production of phantom signals is reduced with respect to any external light that enters via the fresnel lens and wherein in use, a portion of said fresnel lens is directly radiated through said opening by light from said source and said reflective surface directs substantially any remainder of the light from said source toward said fresnel lens to substantially evenly illuminate all of the available fresnel lens area; and a further lens adjacent to and following said fresnel lens, wherein said further lens provides a different angular spread of light in the horizontal and vertical directions.

* * * * *